US008439352B2

(12) United States Patent
Morikawa et al.

(10) Patent No.: US 8,439,352 B2
(45) Date of Patent: May 14, 2013

(54) ROTATION TRANSMISSION MECHANISM AND PAPER FEEDER

(75) Inventors: Takeji Morikawa, Toyokawa (JP); Hiroshi Murasaki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/192,925

(22) Filed: Jul. 28, 2011

(65) Prior Publication Data

US 2012/0043716 A1 Feb. 23, 2012

(30) Foreign Application Priority Data

Aug. 17, 2010 (JP) ..... 2010-182467

(51) Int. Cl.
*B65H 3/06* (2006.01)

(52) U.S. Cl.
USPC ..... 271/118; 271/117; 271/116; 271/10.13

(58) Field of Classification Search ..... 271/10.13, 271/114, 116
See application file for complete search history.

(56) References Cited

U.S. PATENT DOCUMENTS

| | | | | |
|---|---|---|---|---|
| 5,141,217 | A * | 8/1992 | Lim et al. | 271/10.13 |
| 5,259,607 | A * | 11/1993 | Hironori et al. | 271/10.13 |
| 5,265,857 | A * | 11/1993 | Chiang | 271/10.13 |
| 5,435,539 | A * | 7/1995 | Namiki | 271/114 |
| 5,624,109 | A * | 4/1997 | Tanaka | 271/10.13 |
| 5,630,580 | A * | 5/1997 | Tsao et al. | 271/10.13 |
| 6,000,690 | A * | 12/1999 | Kudoh | 271/117 |
| 6,024,356 | A * | 2/2000 | Tanaka et al. | 280/11.214 |
| 6,168,147 | B1 * | 1/2001 | Nose et al. | 271/10.13 |
| 6,336,759 | B1 | 1/2002 | Nakano | |
| 6,817,793 | B2 * | 11/2004 | Kelsay et al. | 400/578 |

FOREIGN PATENT DOCUMENTS

| | | | |
|---|---|---|---|
| JP | H02-028575 | U | 2/1990 |
| JP | 2000-327150 | A | 11/2000 |
| JP | 2001-315986 | A | 11/2001 |
| JP | 2006-076681 | A | 3/2006 |
| JP | 2007-145543 | A | 6/2007 |
| JP | 2010-076912 | A | 4/2010 |

OTHER PUBLICATIONS

Decision to Grant a Patent issued on Apr. 19, 2012, in corresponding Japanese Patent Application No. 2010-182467, and an English translation thereof.

* cited by examiner

*Primary Examiner* — Kaitlin Joerger
(74) *Attorney, Agent, or Firm* — Buchanan Ingersoll & Rooney PC

(57) ABSTRACT

A one-way clutch is mounted on an outer periphery of a rotary shaft in a manner to place a clutch needle bearing in contact with the outer periphery of the rotary shaft. A rotary member is disposed on one side of the one-way clutch and engaged with the one-way clutch to be subjected to the rotation of the rotary shaft transmitted thereto. A retaining member is mounted on the outer periphery of the rotary shaft and located on the opposite side of the one-way clutch from the rotary member, while an urging unit is provided for urging the one-way clutch to abut against the retaining member.

7 Claims, 3 Drawing Sheets

PRIOR ART

ROTATION TRANSMISSION MECHANISM AND PAPER FEEDER

RELATED APPLICATION

The priority application Number Japanese Patent Application 2010-182467 upon which this application is based is hereby incorporated by reference.

BACKGROUND OF THE INVENTION

1. Field of the Invention

The present invention relates to a rotation transmission mechanism and a paper feeder employing the same. The rotation transmission mechanism includes a one-way clutch mounted on an outer periphery of a rotary shaft in a manner to place a clutch needle bearing in contact with the outer periphery of the rotary shaft, and a rotary member disposed on one side of the one-way clutch and engaged with the one-way clutch to be subjected to the rotation of the rotary shaft transmitted thereto. Particularly, the invention is directed to the rotation transmission mechanism wherein the clutch needle bearing of the one-way clutch is maintained in proper contact with the outer periphery of the rotary shaft even if the one-way clutch is mounted on the rotary shaft with some free play, whereby the rotary shaft is prevented from sustaining tilt-induced wear. Thus, the rotation transmission mechanism ensures that the one-way clutch provides stable transmission of the rotation of the rotary shaft to the rotary member over an extended period of time.

2. Description of the Related Art

In image forming apparatuses such as copiers, printers, facsimiles and complex machines combining these functions, cut sheets set in a paper feed cassette or on a document feed tray are fed by a pickup roller and a paper feed roller. As disclosed in Japanese Unexamined Patent Publications No. 2007-145543, No. 2010-76912, No. 2001-315986, No. 2006-76681 and the like, a rotation transmission arrangement is generally employed in which a one-way clutch is mounted on the respective rotary shafts of the pickup roller and the paper feed roller such that the rotation of the rotary shaft is transmitted to the pickup roller or the paper feed roller via the one-way clutches, thus driving the pickup roller or the paper feed roller into rotation.

In the above transmission arrangement wherein the one-way clutch is mounted on the respective rotary shafts of the pickup roller and the paper feed roller such that the rotation of the rotary shaft is transmitted to the pickup roller or to the paper feed roller via the one-way clutches, thus driving the pickup roller or the paper feed roller into rotation, a drive gear 12, 22 is fixed to a rotary shaft 11 of a paper feed roller 10 and a rotary shaft 21 of a pickup roller 20 with a pin 13, 23, respectively, as shown in FIG. 1. An intermediate gear 14 is interposed between these drive gears 12, 22 in meshing engagement therewith so that the rotary shaft 11 of the paper feed roller 10 rotates to drive the rotary shaft 21 of the pickup roller 20 into rotation in the same direction as that of the rotation of the rotary shaft 11 of the paper feed roller 10.

A one-way clutch 30 is mounted on an outer periphery of the rotary shaft 11 of the paper feed roller 10 and an outer periphery of the rotary shaft 21 of the pickup roller 20, respectively, in a manner that a clutch needle bearing 31 of the one-way clutch 30 is placed in contact with the outer periphery of each of the rotary shafts 11, 21. The one-way clutch 30 is formed with an engagement projection 32 on the opposite side thereof from the drive gear 12, 22. The engagement projection 32 is engaged with an engagement recess 15, 25 formed at each of the paper feed roller 10 and the pickup roller 20.

Thus, the rotation of the rotary shaft 11 of the paper feed roller 10 or the rotary shaft 21 of the pickup roller 20 is transmitted to the pickup roller 20 or the paper feed roller 20 via the respective one-way clutches 30 thereby driving the pickup roller 20 or the paper feed roller 10 into rotation.

A cut sheet stored in a paper feed cassette is picked up and transported as follows. As shown in FIG. 2, a backup lever 2 lifts up a leading end portion of a stack of cut sheets P stored in a paper feed cassette 1 so as to bring a cut sheet P into contact with the pickup roller 20. In this state, the paper feed roller 10 and the pickup roller 20 are rotated in the above-described manner, while the rotating pickup roller 20 picks up and feeds a top sheet of the paper stack into space between the paper feed roller 10 and a separation roller 3. The rotating paper feed roller 10, in turn, feeds the cut sheet P into space between a pair of transport rollers 4.

When the pair of transport rollers 4, with the cut sheet P so fed therebetween, starts to rotate to transport the cut sheet P, the rotary shaft 11 of the paper feed roller 10 and the rotary shaft 21 of the pickup roller 20 stop rotating.

Even if the rotary shafts 11, 21 of the paper feed roller 10 and the pickup roller 20 are in the idle state, the respective one-way clutches serve to drive the paper feed roller 10 or the pickup roller 20 to rotate together therewith.

Accordingly, the paper feed roller 10 and the pickup roller 20 rotate in conjunction with the cut sheet P transported by the transport rollers 4, so as to reduce load on the cut sheet P transported by the transport rollers 4.

In the arrangement wherein the one-way clutches 30 are mounted on the rotary shaft 11 of the paper feed roller 10 and the rotary shaft 21 of the pickup roller 20, respectively, and the engagement projections 32 formed at the one-way clutches 30 are engaged with the engagement recesses 15, 25 formed at the paper feed roller 10 and the pickup roller 20, it is a general practice to mount the one-way clutches 30 on the rotary shafts 11, 21 with some free play in consideration of assemblability and the like, as set forth in the above-described Japanese Unexamined Patent Publication No. 2001-315986.

In the case where the one-way clutches 30 are mounted on the rotary shafts 11, 21 with some free play, however, the clutch needle bearings 31 assembled in the one-way clutches 30 fail to be placed in uniform contact with the outer peripheries of the rotary shafts 11, 21. Therefore, when the paper feed roller 10 and the pickup roller 20, with the rotary shafts 11, 21 in the idle state as described above, are rotated together with the corresponding one-way clutches 30, slanted wear is produced on the rotary shafts 11, 21 of the paper feed roller 10 and the pickup roller 20 due to the non-uniform contact by the clutch needle bearings 31.

If the rotary shafts 11, 21 of the paper feed roller 10 and the pickup roller 20 suffer the slanted wear, the one-way clutches 30 may be subjected to an excessive load or the clutch needle bearings 31 of the one-way clutches 30 may fail to make proper contact with the outer peripheries of the rotary shafts 11, 21.

As a result, there occurs a problem that the one-say clutch 30 becomes unable to accomplish proper transmission of the rotation of the rotary shaft 11, 21 to the paper feed roller 10 or the pickup roller 20.

SUMMARY OF THE INVENTION

It is an object of the invention to provide a rotation transmission mechanism comprising a one-way clutch mounted on an outer periphery of a rotary shaft in a manner to place a clutch needle bearing in contact with the outer periphery of the rotary shaft and a rotary member disposed on one side of the one-way clutch and engaged with the one-way clutch to be subjected to the rotation of the rotary shaft transmitted thereto, the rotation transmission mechanism adapted to prevent the occurrence of the tilt-induced wear on the rotary shaft even in the case where the one-way clutch is mounted on the rotary shaft with some free play, thereby ensuring that the one-way clutch provides stable transmission of the rotation of the rotary shaft to the rotary member over an extended period of time.

According to an aspect of the invention, a rotation transmission mechanism comprises: a one-way clutch mounted on an outer periphery of a rotary shaft in a manner to place a clutch needle bearing in contact with the outer periphery of the rotary shaft, and a rotary member disposed on one side of the one-way clutch and engaged with the one-way clutch to be subjected to the rotation of the rotary shaft transmitted thereto, wherein a retaining member is mounted on the outer periphery of the rotary shaft and disposed on the opposite side of the one-way clutch from the rotary member, while an urging unit is provided for urging the one-way clutch to abut against the retaining member.

The above urging unit for urging the one-way clutch to abut against the retaining member may be provided as follows. For example, an urging member for urging the one-way clutch toward the retaining member may be interposed between the rotary member and the one-way clutch. Alternatively, an engagement structure for providing engagement between the one-way clutch and the rotary member may be configured to urge the one-way clutch toward the retaining member in conjunction with the rotation of the rotary member.

According to another aspect of the invention, a paper feeder employs the above-described rotation transmission mechanism for transmitting the rotation of the rotary shaft to the rotary member comprising a roller for feeding paper.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

A rotation transmission mechanism according to an embodiment of the invention and a paper feeder employing this rotation transmission mechanism will be specifically described with reference to the accompanying drawings. It should be understood that the rotation transmission mechanism and the like according to the invention are not limited to the disclosed embodiments. Rather, the invention can be modified to incorporate any number of variations, alterations, substitutions or equivalent arrangements not heretofore described, which are commensurate with the spirit and scope of the invention.

Figure 1:
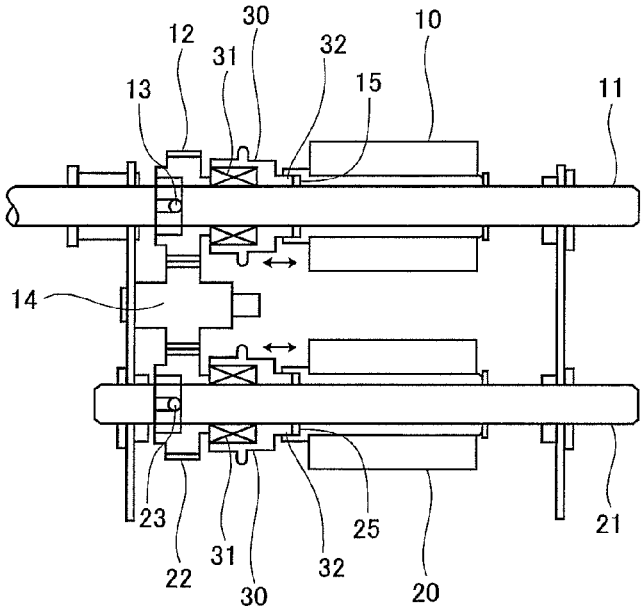
FIG. 1 is a schematic sectional view illustrating an exemplary prior-art rotation transmission mechanism for use in a paper feeder which picks up and transports cut sheets stored in a paper feed cassette, the rotation transmission mechanism serving to transmit the rotation of a rotary shaft of a pickup roller or a paper feed roller to the paper feed roller or the pickup roller by means of one-way clutches.
Figure 3:
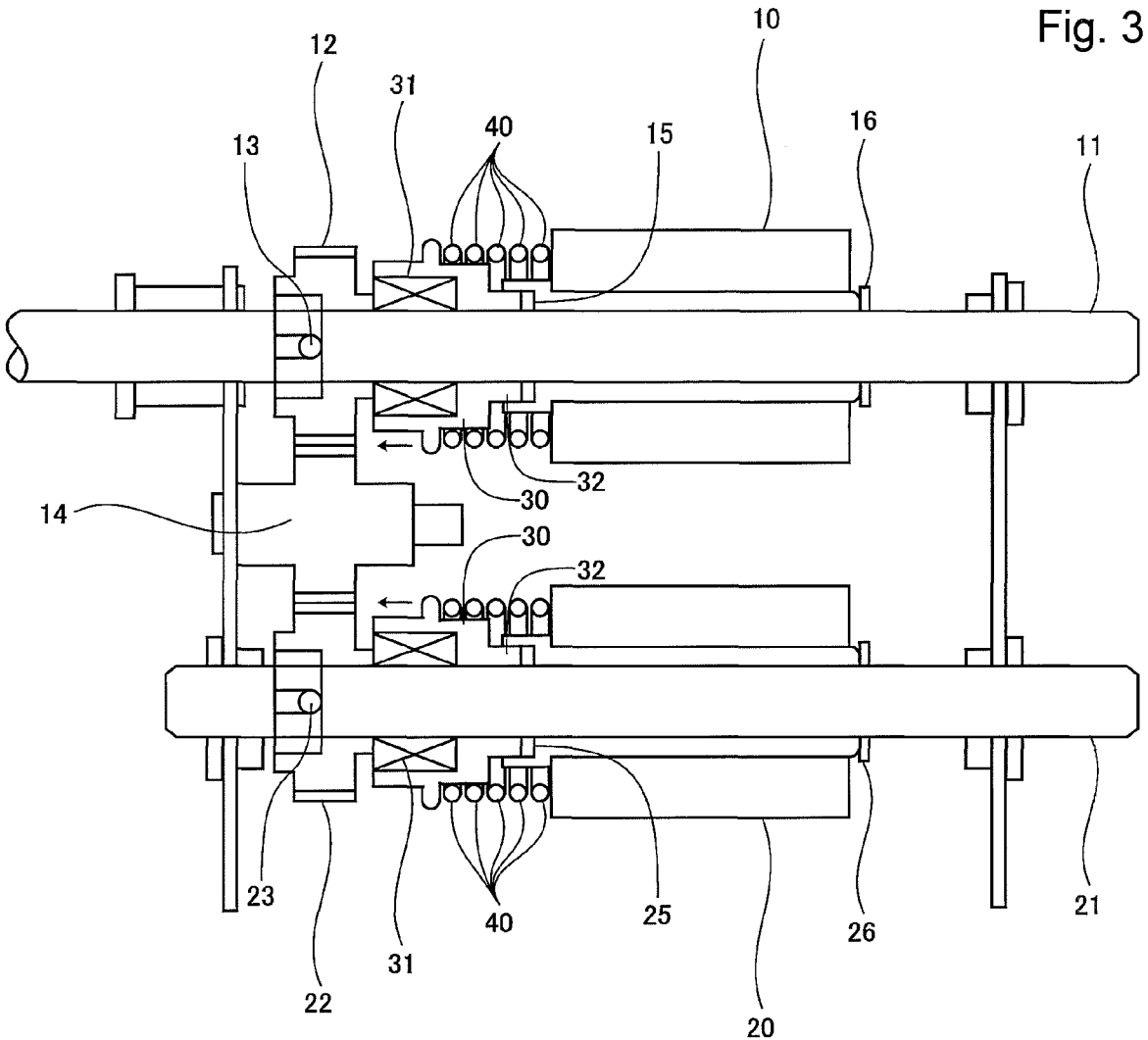
FIG. 3 is a schematic sectional view showing a rotation transmission mechanism according to an embodiment of the invention applied to the paper feeder for picking up and transporting the cut sheets stored in the paper feed cassette, and illustrating how the rotation of the rotary shaft of the pickup roller or the paper feed roller is transmitted to the paper feed roller or the pickup roller by means of the one-way clutches.

As shown in FIG. 3, the rotation transmission mechanism according to the embodiment has a similar arrangement to the above arrangement shown in FIG. 1, wherein drive gears 12, 22 are fixedly mounted to a rotary shaft 11 of a paper feed roller 10 and a rotary shaft 21 of a pickup roller 20 by means of pins 13, 23, respectively, and wherein an intermediate gear 14 is interposed between the drive gears 12, 22 in a manner to mesh with the respective drive gears 12, 22. As the rotary shaft 11 of the paper feed roller 10 rotates, the rotary shaft 21 of the pickup roller 20 is driven to rotate in the same direction as that of rotary shaft 11 of the paper feed roller 10.

A one-way clutch 30 is mounted on the rotary shaft 11 of the paper feed roller 10 and the rotary shaft 21 of the pickup roller 20, respectively, in a manner that clutch needle bearings 31 of the one-way clutches 30 are placed in contact with the respective outer peripheries of the rotary shafts 11, 21. Further, each of the one-way clutches 30 is formed with an engagement projection 32 on the opposite side thereof from the drive gear 12, 22.

The engagement projection 32 formed at each one-way clutch 30 is engaged with an engagement recess 15, 25 formed at each of the paper feed roller 10 and the pickup roller 20 so that the rotation of the rotary shaft 11 of the paper feed roller 10 or the rotary shaft 21 of the pickup roller 20 is transmitted to the pickup roller 20 or the paper feed roller 10 via the one-way clutches 30 thereby driving the pickup roller 20 or the paper feed roller 10 into rotation.

Figure 2:
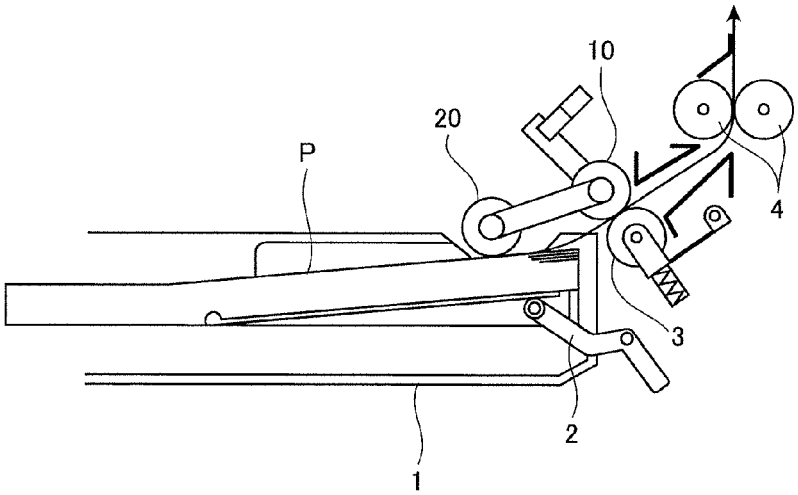
PRIOR ART Fig.2
FIG. 2 is a schematic diagram illustrating the paper feeder for picking up and transporting the cut sheets stored in the paper feed cassette.

In the paper feeder of the embodiment, as well, a leading end portion of a stack of cut sheets P stored in a paper feed cassette 1 is lifted up by a backup lever 2 so that a cut sheet P comes into contact with the pickup roller 20, as shown in FIG. 2. The paper feed roller 10 and the pickup roller 20 are rotated as described above, while the rotating pickup roller 20 picks up and feeds a top sheet of the paper stack into space between the paper feed roller 10 and a separation roller 3. The rotating paper feed roller 10, in turn, feeds the cut sheet P into space between a pair of transport rollers 4.

When the pair of transport rollers 4, with the cut sheet P so fed therebetween, starts to rotate to transport the cut sheet P, the rotary shaft 11 of the paper feed roller 10 and the rotary shaft 21 of the pickup roller 20 stop rotating. In this case, even though the rotary shafts 11, 21 do not rotate as described above, the one-way clutches 30 drive their corresponding paper feed roller 10 and pickup roller 20 to rotate together therewith in conjunction with the cut sheet P transported by the above transport rollers 4. Thus is reduced load on the cut sheet P transported by the transport rollers 4.

In the rotation transmission mechanism of this embodiment, a compression coil spring 40 as an urging member is interposed between the paper feed roller 10 and the one-way clutch 30 mounted on the rotary shaft 11 thereof and between the pickup roller 20 and the one-way clutch 30 mounted on the rotary shaft 21 thereof, respectively. On the rotary shafts 11, 21 of the paper feed roller 10 and the pickup roller 20, ring-like stopper members 16, 26 for inhibiting the movement of the paper feed roller 10 and the pickup roller 20 are attached to respective ends of the paper feed roller 10 and the pickup roller 20 on the opposite sides thereof from the respective one-way clutches 30.

The compression coil spring 40 mounted as described above urges the one-way clutch 30 on the rotary shaft 11 of the paper feed roller 10 toward a retaining member consisting of the drive gear 12 fixed to the rotary shaft 11 with the pin 13 as described above. On the other hand, the compression coil spring 40 urges the one-way clutch 30 on the rotary shaft 21 of the pickup roller 20 toward a retaining member consisting of the drive gear 22 fixed to the rotary shaft 21 with the pin 23.

Such an arrangement affords the following advantage. Even in the case where the one-way clutches 30 are mounted on the respective rotary shafts 11, 21 with some free play, the compression coil springs 40 apply forces perpendicular to respective end faces of the drive gears 12, 22 fixed to the rotary shafts 11, 21, namely to the annular end faces of the drive gears 12, 22 that are perpendicular to the rotary shafts 11, 21, thereby evenly pressing the one-way clutches 30 against the end faces. This ensures that the respective one-way clutches 30 are maintained in a stable position free from tilt.

Therefore, the clutch needle bearings 31 assembled in the one-way clutches 30 are maintained in uniform contact with the outer peripheries of the rotary shafts 11, 21, respectively. Hence, the occurrence of slanted wear in the rotary shafts 11, 21 of the paper feed roller 10 and the pickup roller 20 is prevented in the above-described case where, with the rotary shafts 11, 21 in the idle state, the cut sheet P transported by the transport rollers 4 causes the paper feed roller and the pickup roller 20 to rotate together with the corresponding one-way clutches 30.

Therefore, the rotation transmission mechanism of this embodiment can obviate the problems of the prior art that the one-way clutch 30 is subjected to an excessive load and that the clutch needle bearing 31 of the one-way clutch 30 fails to make a proper contact with the outer periphery of the rotary shaft 11, 21. As a result, the rotation transmission mechanism of the embodiment ensures that the individual one-way clutches 30 provide stable transmission of the rotation of the respective rotary shafts 11, 21 to the paper feed roller 10 and the pickup roller 20 over an extended period of time. Thus, the rotation transmission mechanism ensures stable paper feed over an extended period of time.

In the rotation transmission mechanism of the embodiment, the compression coil springs 40 are employed for urging the one-way clutches 30 toward the drive gears 12, 22 fixed to the rotary shafts 11, 21 of the paper feed roller 10 and the pickup roller 20, respectively. However, the urging unit for urging the one-way clutches 30 toward the drive gears 12, 22 fixed to the rotary shafts 11, 21 of the paper feed roller 10 and the pickup roller 20 is not limited to this.

Figure 4:
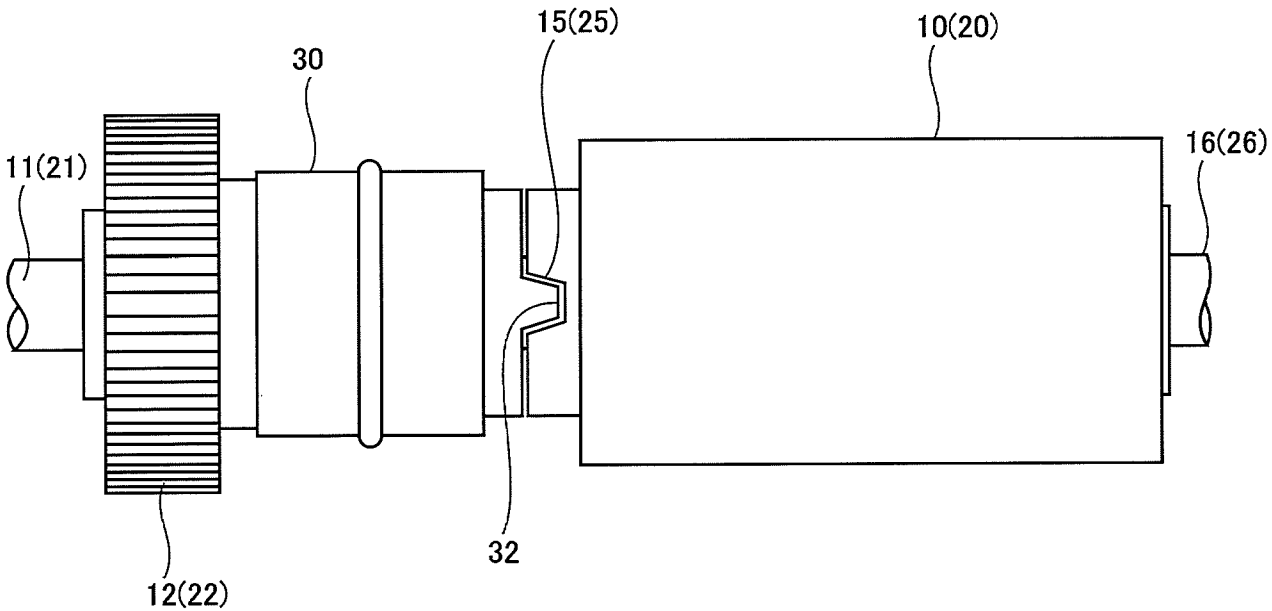
FIG. 4 is a schematic diagram illustrating an exemplary modification of the rotation transmission mechanism of the above embodiment wherein an urging unit for urging the one-way clutch to abut against a retaining member is altered.

As shown in FIG. 4, for example, the engagement projection 32 formed at the one-way clutch 30 is configured to have a trapezoidal section or tapered toward the paper feed roller 10 or the pickup roller 20. At the paper feed roller 10 and the pickup roller 20, on the other hand, the engagement recess 15, 25 engageable with the engagement projection 32 is configured to have an inverted trapezoidal section or progressively expanded toward the one-way clutch 30. When the paper feed roller 10 or the pickup roller 20 rotates, the tapered engagement projection 32 of the one-way clutch 30 is pushed by the slant surface of the inverted tapered engagement recess 15, 25 formed at the paper feed roller 10 or the pickup roller 20 so that the one-way clutch 30 is urged toward the drive gear 12, 22 fixed to the rotary shaft 11, 21 of the paper feed roller 10 or the pickup roller 20.

While the rotation transmission mechanism of the embodiment is applied to the paper feed roller 10 and the pickup roller 20 used for picking up and transporting the cut sheets P stored in the paper feed cassette 1, the application of the rotation transmission mechanism of the invention is not limited to this. The rotation transmission mechanism of the invention is also applicable to a paper feeder which picks up and transports cut sheets set on a document feed tray, and can also find other applications.

The rotation transmission mechanism of the invention includes: the one-way clutch mounted on the outer periphery of the rotary shaft in a manner to place the clutch needle bearing in contact with the outer periphery of the rotary shaft, and a rotary member disposed on one side of the one-way clutch in engaging relation with the one-way clutch. For positive transmission of the rotation of the rotary shaft to the rotary member via the one-way clutches, the retaining member is mounted on the outer periphery of the rotary shaft and located on the opposite side of the one-way clutch from the rotary member, while the urging unit urges the one-way clutch to abut against this retaining member.

Even in the case where the one-way clutch is mounted on the rotary shaft with some free play, the one-way clutch is urged by the urging unit and maintained in abutment against the retaining member so that the one-way clutch is prevented from tilting. Hence, the clutch needle bearing assembled in the one-way clutch is maintained in uniform contact with the outer periphery of the rotary shaft, thereby preventing the occurrence of the slanted wear on the rotary shaft.

As a result, the rotation transmission mechanism of the invention can eliminate the problems of the prior art that the one-way clutch is subjected to the excessive load and that the clutch needle bearing of the one-way clutch fails to make the proper contact with the outer periphery of the rotary shaft. Thus, the one-way clutch ensures the stable transmission of the rotation of the rotary shaft to the rotary member over an extended period of time.

In the paper feeder which employs such a rotation transmission mechanism for transmitting the rotation of the rotary shaft to the rotary member consisting of the roller for feeding paper, a stable paper feeding is ensured over an extended period of time.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. A rotation transmission mechanism comprising:

a rotary shaft that rotates;

a one-way clutch mounted on an outer periphery of the rotary shaft in a manner to place a clutch needle bearing in contact with the outer periphery of the rotary shaft; and a rotary member disposed on one side of the one-way clutch and engaged with the one-way clutch to be subjected to the rotation transmitted from the rotary shaft, wherein a retaining member is mounted on the outer periphery of the rotary shaft and disposed on the opposite side of the one-way clutch from the rotary member, while an urging unit is provided for urging the one-way clutch to abut against the retaining member.

2. The rotation transmission mechanism according to claim 1, wherein an urging member, as the urging unit, is provided between the rotary member and the one way clutch for urging the one-way clutch toward the retaining member.

3. The rotation transmission mechanism according to claim 1, wherein an engagement structure providing engagement between the one-way clutch and the rotary member is configured, as the urging unit, to urge the one-way clutch toward the retaining member in conjunction with the rotation of the rotary member.

4. The rotation transmission mechanism according to claim 1, wherein the retaining member is configured to be point symmetric in relation to the rotary shaft.

5. The rotation transmission mechanism according to claim 1, wherein the retaining member has an annular face perpendicular to the rotary shaft, and the one-way clutch in contact with the annular face also has a face perpendicular to the rotary shaft.

6. A paper feeder comprising a rotation transmission mechanism for transmitting the rotation of a rotary shaft to a rotary member comprising a roller for feeding paper, wherein the rotation transmission mechanism is the rotation transmission mechanism according to claim 1.

7. The rotation transmission mechanism according to claim 1, wherein the rotary shaft has a longitudinal direction, and wherein the one-way clutch is movable along the longitudinal direction of the rotary shaft.

* * * * *